United States Patent [19]

Albrecht

[11] Patent Number: 4,563,960

[45] Date of Patent: Jan. 14, 1986

[54] SEWING MACHINE HAVING A DRIVE FOR A WORK CLAMP

[75] Inventor: Ernst Albrecht, Hochspeyer, Fed. Rep. of Germany

[73] Assignee: Pfaff Industriemaschinen GmbH, Fed. Rep. of Germany

[21] Appl. No.: 704,643

[22] Filed: Feb. 22, 1985

[30] Foreign Application Priority Data

Feb. 23, 1984 [DE] Fed. Rep. of Germany ..... 3406484

[51] Int. Cl.[4] ..... D05B 21/00

[52] U.S. Cl. ..... 112/121.15; 112/311

[58] Field of Search ..... 112/121.15, 121.12, 112/121.11, 311

[56] References Cited

U.S. PATENT DOCUMENTS 4,002,129 1/1977 Kraatz ..... 112/121.15
4,114,545 9/1978 Manabe et al. ..... 112/121.15
4,422,393 12/1983 Johnson et al. ..... 112/121.15
4,461,227 7/1984 Abrams et al. ..... 112/121.15

*Primary Examiner*—H. Hampton Hunter
*Attorney, Agent, or Firm*—McGlew and Tuttle

[57] ABSTRACT

A sewing machine with a drive for a work clamp comprises two slides movable relative to each other, one carrying the work clamp and the other carrying two tail wheels and an endless belt trained thereabout. Two stepping motors which can selectively be run in the same or in opposite directions are engaged each with a respective one of the belt strands, so that with the motors running in opposite directions, the two slides move in the lengthwise direction, while with a run in the same directions, only the slide directly carrying the work clamp is moved, namely transversely. In another embodiment, the slide directly carrying the work clamp is non-rotatably connected to one of the tail wheels.

9 Claims, 5 Drawing Figures

SEWING MACHINE HAVING A DRIVE FOR A WORK CLAMP

FIELD AND BACKGROUND OF THE INVENTION

This invention relates in general to sewing machines and in particular to a new and useful sewing machine drive for moving a workpiece clamp relative to a reciprocating thread guiding needle.

A sewing machine similar to the present invention is disclosed in U.S. Pat. No. 4,114,545, dated Sept 19, 1978. That machine is equipped with a work clamp which is secured to movable supports forming a compound slide. Each of the two slides is drivably connected to a stationary stepping motor through an endless belt trained about a plurality of stationary deflecting rollers which are partly provided on one of the slides, in a manner such that the belt is passed around a roller which is secured to the motor shaft. By mounting the stepping motors in stationary positions and employing relatively light-weight drive transmission elements, a low-inertia supporting system is obtained for the work clamp and the drive mechanism. On the other hand, disadvantageously, the construction is expensive since a large number of deflection rollers is needed. Also, there is a risk that due to the greater length of the individual belts, elastic deformations, or permanent deformations caused by material fatigue, for example, may become excessive and cause inaccuracies in the control of the work clamp.

SUMMARY OF THE INVENTION

The present invention is directed to a mechanism for the drive of a workpiece using stepping motors and which not only has a small inertia but also is simple in construction and the steps produced by the stepping motors are transmitted to the work clamp always accurately.

With the two stepping motors running at the same step rate and in opposite directions, the entire draw member is displaced parallel to the lengthwise direction of its sections or strands. This movement is transmitted through the bearing bolts of tail wheels to a first of two slides, so that both of the slides and the work clamp are displaced in a first direction. With the two stepping motors running at the same step rate and in the same direction, the draw member performs a circulatory motion and turns the tail wheels. This circulartory motion is transmitted to the second slide, so that the work clamp is moved in second, substantially transverse, direction. Since a single draw member is employed for transmitting the drive motion of both stepping motors to the mutually movable slides, and since this draw member is trained about only a few deflection wheels, the drive mechanism requires only a very small number of simple component parts.

Due to the relatively small length of the draw member, the number of deflecting and tail wheels is small and neither elastic nor permanent variations in length of the draw member can produce a notable effect, so that the accuracy of transmission of the drive mechanism is high.

If only square or rectangular sewing patterns are provided having seam sections parallel to the axes of motion of the two slides, the drive motion is produced by the two stepping motors always conjointly. Since in such an instance the stepping motors furnish the necessary force proportionally, they can be dimensioned for a reduced power as compared to conventional drive systems where in every instance a single motor is used for effecting the lengthwise or transverse motion.

Accordingly, it is an object of the invention to provide a sewing machine drive for moving a workpiece clamp relative to a thread guiding needle which comprises a first slide having gear means thereon and first and second stepping motors each having a driving shaft for the drive pinion engaged with a gear belt having spaced apart strand portions with gear teeth engaged with respective gear means of the first slide and which includes a second workpiece carrying slide having a gear mechanism engaged with the drive pinion for moving this slide relative to the first slide relative to the needle for shifting the clamp in respect thereto.

A further object of the invention is to provide a sewing machine drive for a workpiece clamp which is simple in design, rugged in construction and economical to manufacture.

The various features of novelty which characterize the invention are pointed out with particularity in the claims annexed to and forming a part of this disclosure. For a better understanding of the invention, its operating advantages and specific objects attained by its uses, reference is made to the accompanying drawings and descriptive matter in which preferred embodiments of the invention are illustrated.

DESCRIPTION OF THE PREFERRED EMBODIMENTS

Figure 1:
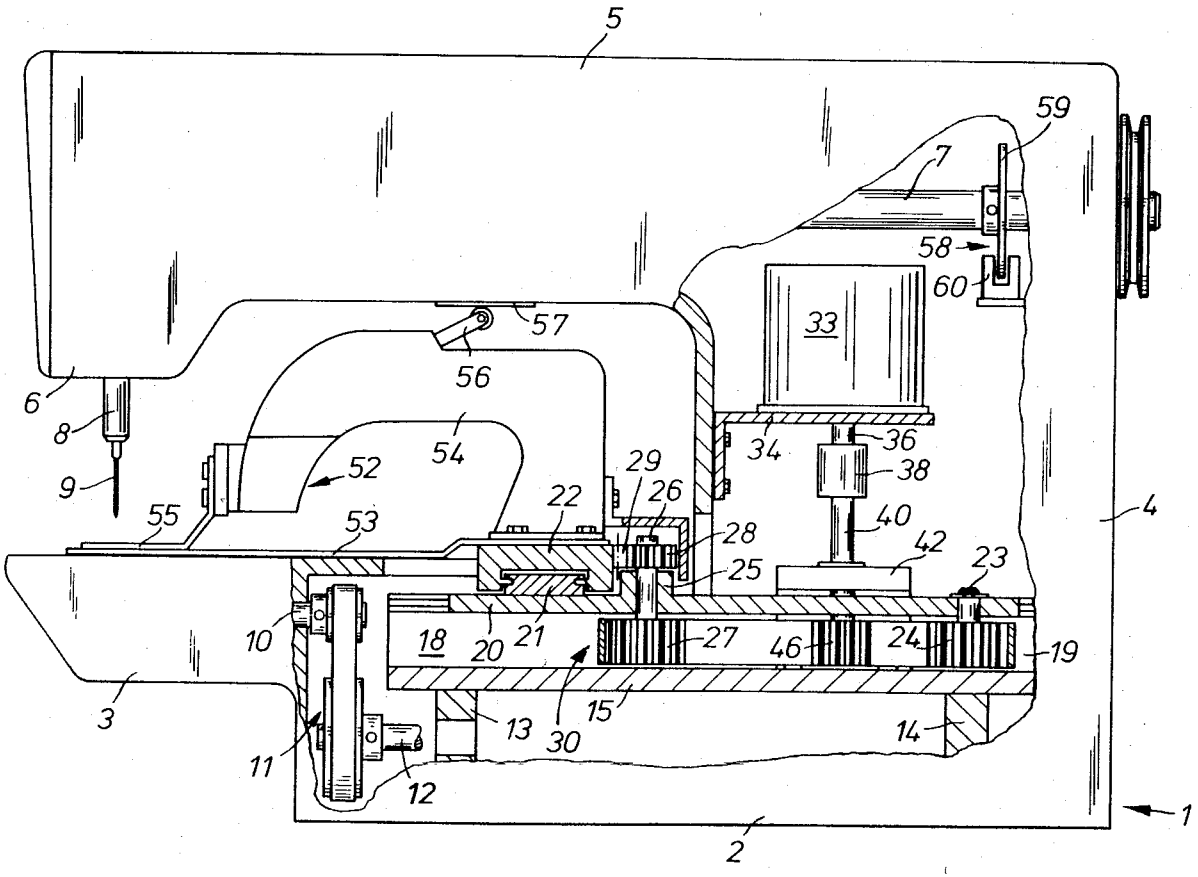
FIG. 1 is a partial sectional and partly elevational view of a sewing machine equipped with a work clamp.
Figure 2:
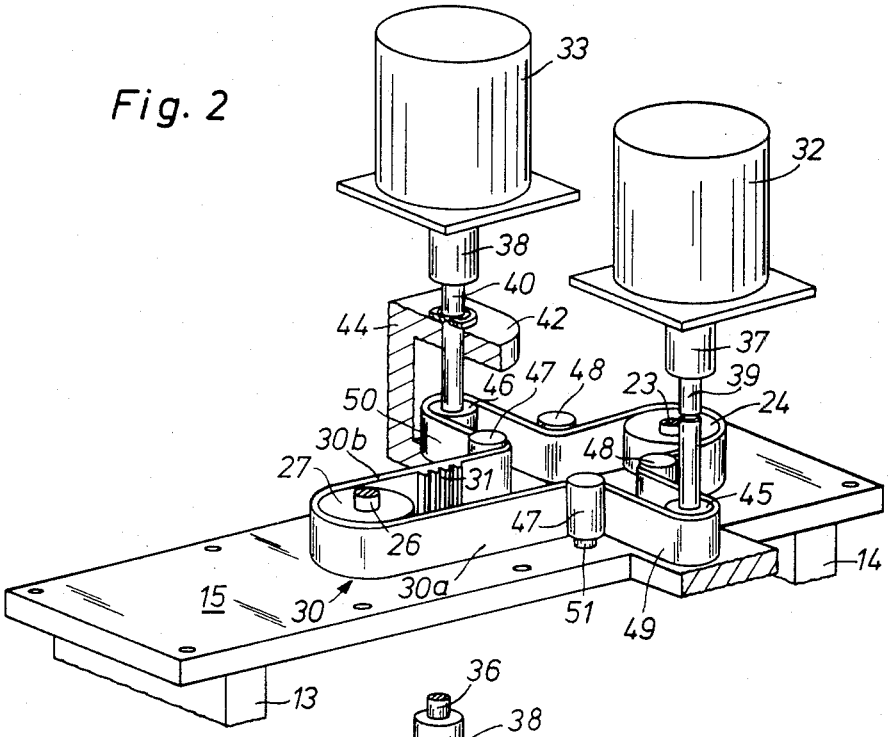
FIG. 2 is a perspective view of a part of the drive mechanism of the work clamp.

Referring to the drawings in particular the invention embodied therein comprises a sewing machine generally designated 1 which has a drive for moving a workpiece clamp generally designated 52 relative to a reciprocating thread guiding needle 9. The drive includes a first slide 20 which has gear means thereon which in the embodiment of FIG. 1 includes a rotatable gear 28, a rotatable gear 27 providing a drive for the first slide on one or two stepping motors 32 and 33 which have drive pinions 45 and 46 which drive the slide through gear teeth 31 of an endless draw member or gear belt 30. A second work-piece carrying slide 22 is movable relative to the first slide and it has a gear mechanism including rack gear 29 engaged with a gear 28 driven by the stepping motor so that it is also engaged with a drive pinion of a stepping motor through the endless draw member 30. Either a single stepping motor or both stepping motors may be driven to produce a control effect of the movement of the second slide 22 which carries the workpiece clamp 52.

The sewing machine comprises a housing 1 including a base 2, a base extension 3, a post 4, and an arm 5 terminating with a head 6. Within arm 5, an armshaft 7 is mounted driving a needle bar 8 in a manner known per se. Secured in needle bar 8 is a thread guiding needle 9 cooperating with a rotary hook (not shown) to form sewing stitches. A shaft 10 carrying the the rotary hook is connected through a cog or gear belt drive 11 to a shaft 12 which is driven by armshaft 7 in a manner known per se (not shown).

Figure 3:
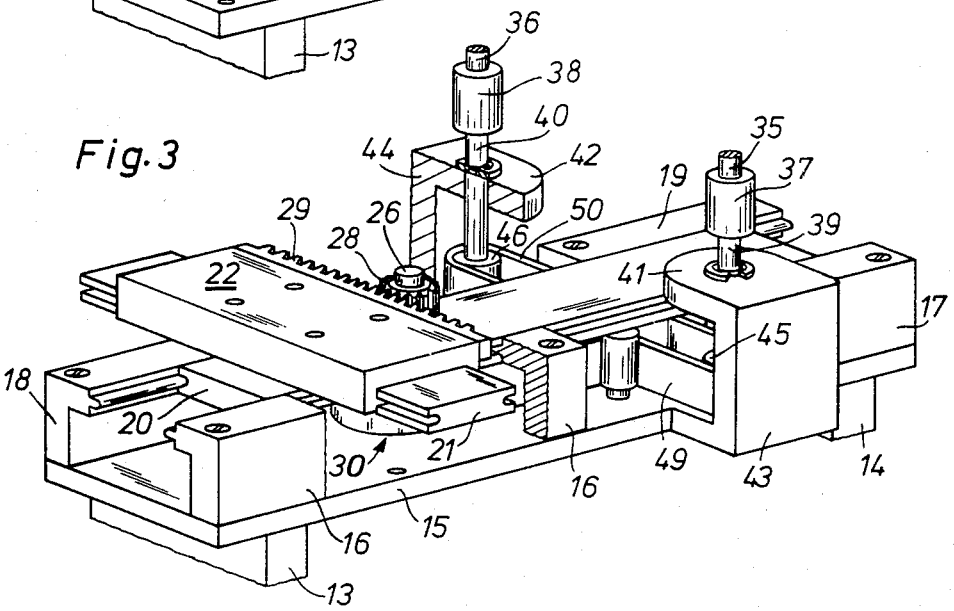
FIG. 3 is a perspective view similar to FIG. 2 showing in addition the compound slides.

A horizontally extending plate 15 is secured to two frame members 13, 14 of housing 1. Two mutually aligned but spaced apart guide strips 16 and 17 and 18 and 19 (FIG. 3), respectively, are secured to plate 15 at respective ends of the lengthwise sides thereof. Guide strips 16 to 19 extend parallel to the longitudinal direction of base extension 3. A slide 20 is mounted for displacement on guide strips 16 to 19. Slide 20 carries a crosswise extending guide plate 21 carrying a cross slide 22.

A shaft or bolt 23 is mounted for rotation, yet secured against axial displacement, in slide 20 and carries, at the underside of the slide, a cog wheel or gear 24. Further mounted for rotation and secured against axial displacement in slide 20 or in an upward protrusion or hub 25 thereof, is a bolt 26 carrying, at the underside of the slide, another cog wheel or gear 27 and, above the protrusion 25, a pinion 28. Both cog wheel 27 and pinion 28 are non-rotatably secured to bolt 26. Pinion 28 meshes with a rack 29 which is provided on cross slide 22.

Trained about cog wheels 24,27 is a cog belt or gear belt 30 with inwardly protruding cogs 31. The belt 30 has two sections or strands designated 30*a* and 30*b*. To drive cog belt 30 two stepping motors 32,33 are provided which are supported on an angle plate 34 secured to the inside of post 4. The motor shafts 35,36 are connected through respective clutches 37 and 38 to respective shafts 39 and 40. Shafts 39,40 ar mounted each in the upper leg 41,42 of a U-bracket 43,44 of plate 15 and are secured against axial displacement and carry pinions 45 and 46 on their respective ends. By means of two pairs of corner rollers 47, cog belt 30 is deflected to form loops 49 and 50 which embrace respective pinions 45 and 46. Corner rollers 47 and 48 are mounted for rotation and secured against axial displacement on botls 51 which are fixed to plate 15.

Secured to cross slide 22 is a work clamp 52 comprising a plate-shaped arm 53 and a cantilever 54 carrying a spring-loaded holding plate 55. Holding plate 55 can be lifted from arm 53 in a known manner, by means of a roller lever 56 and a vertically movable thrust plate 57.

To synchronize stepping motors 32,33 with the motion of needle bar 8, a prior art pulse generator 58 is provided. The pulse generator comprises a pulse disc 59 which is secured to armshaft 7 and provided with a plurality of division marks (not shown) and a pickup 60 responsive to the marks.

Figure 4:
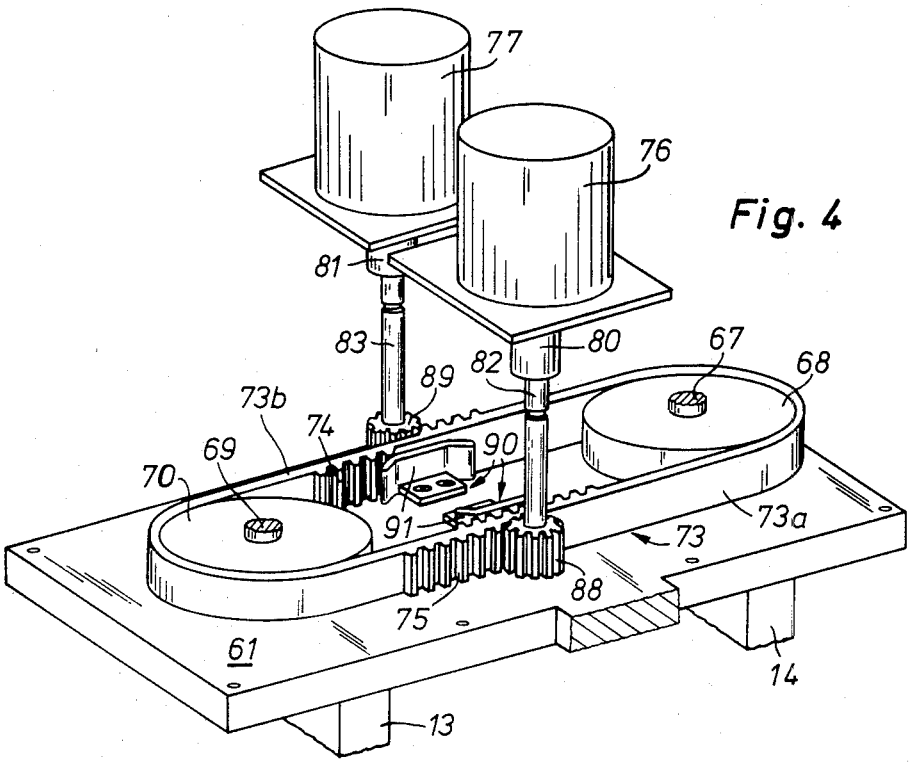
FIG. 4 is a perspective view of another embodiment of the drive mechanism.
Figure 5:
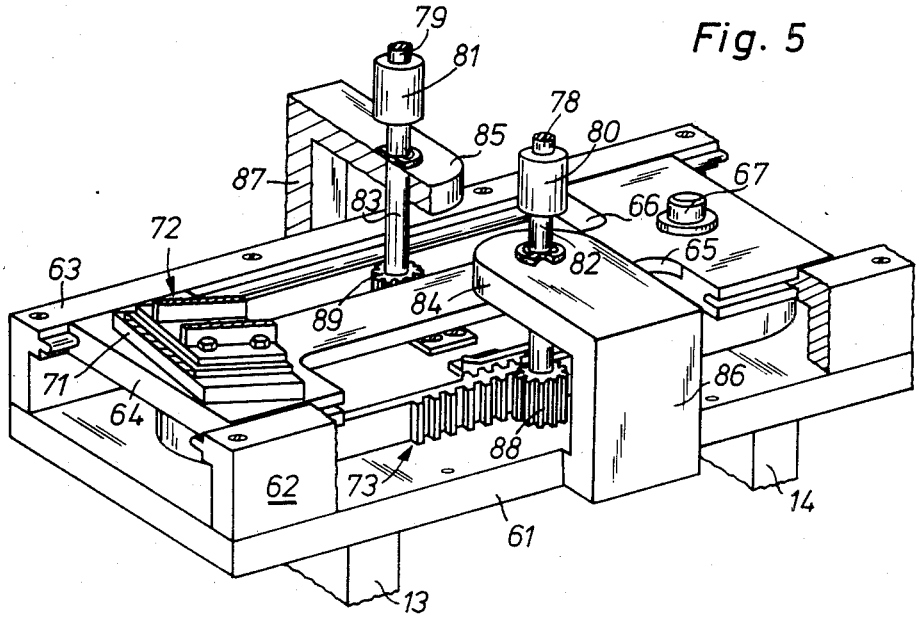
FIG. 5 is a view similar to FIG. 4 including the compound slides.

In another embodiment shown in FIGS. 4 and 5, a plate 61 is secured to the frame members 13, 14 of an unchanged housing 1. Secured to plate 61 are spaced-apart guide strips 62,63 on which a slide 64 is displaceable. On each of its two lengthwise sides, slide 64 is provided with an elongated recess 65,66.

A bolt 67 mounted for rotation and axially secured in slide 64 carries a cog wheel 68 at the underside of the slide. Further mounted for rotation and secured against axial movement in slide 64 is a bolt 69 carrying another cog wheel 70 beneath the slide, and a carrier plate 71 above the slide 64. Both cog wheels 70 and carrier plate 71 are fixedly secured to bolt 69. A work clamp 72 corresponding to work clamp 52 of the first embodiment is secured to carrier plate 71.

Trained about cog wheel 68,70 is a cog belt 73 having cogs 74 inside and 75 outside. The sections of cog belt 73 are designated 73*a* and 73*b*. Stepping motors 32, 33 corresponding to those of the first embodiment and also secured to post 4 in the same way are provided for driving cog belt 73. Each of motor shafts 78,79 (FIG. 5) is connected through a clutch 80,81 to a shaft 82, 83. Shafts 82, 83 are mounted each in the upper leg 84, 85 of an L-bracket 86,87 of plate 61, and they are secured on their lower end portions. Pinions 88,89 engage the outside of cog belt 73 and thus cooperate with outer cogs 75. Further secured to plate 61 are two angle pieces 90 having their vertical legs 91 applied against the inside of cog belt 73, at locations which are opposite to pinions 88,89.

A belt having cogs outside might also drive a slide carrying the work clamp and movable crosswise as slide 22. In such an instance, the cogs of the belt might mesh directly with a rack secured to the slide.

The drive mechanism operates as follows:

With the sewing machine running, the two stepping motors 32,33 or 76,77 operate in synchronism with the stitch formation, i.e. they effect drive movements if needle 9 is in a position above the work which is held in clamp 52,72.

If work clamp 52 of the first embodiment is to be moved in the longitudinal direction of base extension 3, the two stepping motors 32,33 rotate at equal step rates in mutually opposite directions. Thereby, the two sections 30*a*, 30*b* of cog belt 30 are driven in the same direction and the entire belt is displaced in the longitudinal direction of the base extension 3. This movement is transmitted through cog wheels 24, 27 which do not rotate in this instance, and through bolts 23, 26 to slide 20 which is thereby displaced, together with slide 22 and work clamp 52, along guide strips 16 to 19 in the same direction.

If it is desired to move work clamp 32 transversely to the longitudinal direction of base extension 3, the two stepping motors 32, 33 are run at equal step rates in the same direction. In such an instance, the two sections 30*a* and 30*b* of cog belt 30 are driven in opposite directions, so that belt 30 moves and takes cog wheels 24,27 along while slide 20 is at standstill. Pinion 28 rotates along with cog wheel 27, thereby displacing rack 29 and slide 22 with work clamp 52 transversely to the longitudinal direction of base extension 3.

If only one of the stepping motors runs, for example motor 32, cog belt 30 is backed up by pinion 46 of the stopped motor 33 and cog wheels 24,27 roll on the stepped belt section 30*b*. Consequently, slide 20 is also moved, as in the first described instance, yet by only half the distance it would move with the two motors running in opposite directions. At the same time, pinion 28 rotates through half the angle it would rotate with the two motors 32, 33 running in the same direction. The simultaneous lengthwise motion of slide 20 and rotary motion of pinion 28 produce the effect that work clamp 52 moves obliquely to the longitudinal direction of base extension 3, at an angle which depends on the difference between the diameters of cog wheel 27 and pinion 28. Should cog wheel 27 and pinion 28 have equal diameters, the angle of oblique motion would be 45°.

While in the first embodiment, work clamp 52 is movable either simultaneously or separately, in the lengthwise and transverse directions, the second embodiment enables the work clamp 72 to perform simultaneously or separately a lengthwise or a pivotal motion.

To move the work clamp 72 in the lengthwise direction of base extension 3, both of the stepping motors 76,77 are run at equal step rates and in opposite directions, in the same manner as stepping motors 32,33 of the first embodiment.

To obtain a pivotal movement of work clamp 72, stepping motors 76,77 are run at equal step rates and in the same direction. Thereby, the circulatory motion of cog belt 73 is transmitted through cog wheel 70 directly to work clamp 72.

If only one of the two stepping motors 76 or 77 is working, slide 64 is moved in the lengthwise direction and carrier plate 71 is pivoted at the same time, so that work clamp 72 moves in a cycloidal path. By correspondingly actuating both stepping motors 76,77 work clamp 72 may be moved also along any oblique straight line or path of any shape.

While specific embodiments of the invention have been shown and described in detail to illustrate the application of the principles of the invention, it will be understood that the invention may be embodied otherwise without departing from such principles.

What is claimed is:

1. A sewing machine drive for moving a workpiece clamp relative to a reciprocating thread guide needle, comprising a slide, tail wheel means mounted to said slide for movement with respect to said slide, first and second stepping motors each having a driving shaft with a drive pinion, a draw member having first and second spaced apart strand portions each engaged with one drive pinion, said draw member being engaged with said tail wheel means for movement of said slide and said tail wheel means with selective rotation of at least one shaft, a plate member carried by said slide and operatively connected to said tail wheel means for movement of said plate member with respect to said slide with selective rotation of at least one shaft, said plate member being connected to the workpiece clamp whereby selective rotation of the drive shaft for each of said first and second stepping motors effects selective movement of said slide, said tail wheel means and said plate member to move the workpiece clamp.

2. A sewing machine according to claim 1, wherein said tail wheel means comprise a pair of spaced apart gears rotatably mounted to said slide, said draw member comprising a gear belt.

3. A sewing machine according to claim 2, wherein said plate member comprises a second slide slidably mounted on said first mentioned slide for movement transverse to movement of said mentioned slide, said second slide having a rack, a pinion connected to one of said spaced gears and engaged with said rack for transverse movement of said second slide with respect to said first mentioned slide.

4. A sewing machine according to claim 2, wherein said plate member is rotatably mounted on said slide and connected to one of said two spaced gears for rotation of said plate member with respect to said slide.

5. A sewing machine having a work clamp and a drive therefor, said drive comprising a first movable slide, a second slide which is carried on said first slide and is movable relative thereto, a work clamp mounted on said second slide, two spaced apart stepping motors, means mounting said stepping motors in a fixed location relative to said first slide, each of said stepping motors having a drive pinion, an endless draw member entrained about said drive pinions and having a drive connection between said drive pinions and said endless draw member, said drive pinions being selectively runnable by said stepping motors in either direction and being engaged with separate strand portions of said endless draw member to move the strand portions in a selected direction.

6. A sewing machine according to claim 5, wherein said second slide is mounted on said first slide and is displaced transversely to the longitudinal axis of said first slide and has a gear rack portion, a pinion driven by said endless draw member in meshing engagement with said gear rack portion.

7. A sewing machine according to claim 6, including a gear member engaged with said endless draw member and driven thereby and having a rotatable shaft rotatably mounted in said second slide.

8. A sewing machine according to claim 5, wherein said draw member comprises a cog belt having inside cogs, said stepping motors having drive pinions engaged with said cog belt and deflecting rollers engaging said cog belt providing means for enlarging the angles of grip of said belt by forming drive loops.

9. A sewing machine according to claim 8, wherein said cog belt has inside and outside cogs, and said pinions of said stepping motors engage said cogs from the exterior thereof.

* * * * *